United States Patent [19]
Kosuda et al.
[11] 4,452,188
[45] Jun. 5, 1984

[54] APPARATUS FOR CONTROLLING FEED OF OIL DISCHARGED FROM OIL PUMP

[75] Inventors: Tooru Kosuda; Hiromi Katou, both of Okazaki; Masaaki Takizawa, Mishima; Masaru Tamura, Susono; Noboru Matsubara, Susono; Tsutomu Hiyoshi, Susono, all of Japan

[73] Assignee: Nippon Soken, Inc., Nishio, Japan

[21] Appl. No.: 368,969

[22] Filed: Apr. 16, 1982

[30] Foreign Application Priority Data

Apr. 17, 1981 [JP] Japan ..... 56-57019

[51] Int. Cl.³ ..... F01L 1/34; F01L 13/00

[52] U.S. Cl. ..... 123/90.18; 123/90.39; 123/196 R

[58] Field of Search ..... 123/385, 386, 501, 502, 123/90.18, 196 R, 90.15, 90.16, 90.17, 90.39

[56] References Cited

U.S. PATENT DOCUMENTS

| | | | |
|---|---|---|---|
| 1,794,518 | 3/1931 | Herr | 123/386 |
| 3,057,436 | 10/1962 | Jacobson et al. | 123/196 A |
| 3,119,229 | 1/1964 | Wolf | 123/90.15 |
| 3,633,554 | 1/1972 | Nakajima | 123/90.15 |
| 3,815,564 | 6/1974 | Suda et al. | 123/501 |
| 4,254,749 | 3/1981 | Krieg et al. | 123/90.55 |
| 4,275,691 | 6/1981 | Wolff et al. | 123/385 |
| 4,331,112 | 5/1982 | Pluequet | 123/196 S |
| 4,354,460 | 10/1982 | Mae et al. | 123/90.39 |
| 4,387,673 | 6/1983 | Aoyama | 123/90.39 |

FOREIGN PATENT DOCUMENTS

| | | | |
|---|---|---|---|
| 55-91767 | 7/1980 | Japan | 123/90.18 |
| 56-92329 | 7/1981 | Japan | 123/502 |

*Primary Examiner*—Charles J. Myhre
*Assistant Examiner*—E. Rollins Cross
*Attorney, Agent, or Firm*—Cushman, Darby & Cushman

[57] ABSTRACT

An apparatus for controlling the feed of the oil discharged from an oil pump in an internal combustion engine having an oil pump which feeds lubricating oil to the engine by an oil delivery pipe and which feeds working oil to a hydraulic actuator for controlling valve timings of the engine by a branch pipe connected to the oil delivery pipe, comprising valve means in said oil delivery pipe downstream of the connection between the oil delivery pipe and the branch pipe, which opens in accordance with the delivery pressure of the discharged oil to control the amount of the lubricating oil flowing therethrough.

10 Claims, 6 Drawing Figures

APPARATUS FOR CONTROLLING FEED OF OIL DISCHARGED FROM OIL PUMP

FIELD OF THE INVENTION

This invention relates to an apparatus for controlling the feed of lubricating oil discharged from an oil pump, more particularly, to a hydraulic actuator for controlling valve timings in an internal combustion engine.

DESCRIPTION OF THE PRIOR ART

In an internal combustion engine provided with intake, exhaust, and other valves, open and close timings of the valves are controlled in accordance with engine driving conditions. The valves are actuated by cams mounted on a cam shaft or shafts. As is well known, cams having different cam profiles are usually mounted side by side on the cam shaft for the control of the valve timings. The cams, i.e., the cam profiles, are selectively used by axially moving the cam shaft or the rocker arms which transmit(s) the movement of the cams to the associated valves. Usually, a hydraulic cylinder is used to actuate the cam shaft or the rocker arms (referred to hereinafter as valve timing control means) to select the different cam profiles. The hydraulic cylinder has a piston connected to the valve timing control means so as to actuate the control means.

Alternatively, an internal combustion engine provided with engine cylinders each with two intake ports each having a valve therein is also known. One of the valves (auxiliary valve) usually remains closed and opens only at a predetermined engine condition, for example, at a high load to increase the amount of the intake. The other valve corresponds to a conventional intake valve. In this kind of engine too, cams having different cam profiles are mounted side by side on the cam shaft. When the auxiliary valve is selectively opened, the valve timing control means must be displaced in the axial directions of the cam shaft to select the cams, by means of a hydraulic cylinder.

In both cases, the hydraulic cylinder is actuated by oil discharged from an oil pump which is, in turn, driven by the engine. The discharged oil is usually also used for lubricating the engine. That is, the oil discharged from the oil pump is used, on one hand, as a lubricating oil of the engine and, on the other hand, as the working oil of the hydraulic cylinder.

When the engine speed is low, however, all of the discharged oil is usually needed for lubrication. When the hydraulic cylinder is actuated to move the valve timing control means under such a state, the delivery pressure of the discharged oil is not large enough to quickly move the piston of the hydraulic cylinder, especially at the initial stage of operation of the hydraulic cylinder, thus lengthening the response time during which one cam profile is replaced by another. This is particularly disadvantageous when the engine driving conditions suddenly vary, for example, when the speed is suddenly decreased. That is, when the speed is shifted from high to low, the cam with a cam profile for high speeds is axially displaced and replaced by the cam with a cam profile for low speeds. However, unless the cam for high speeds is quickly displaced, it will not finish being replaced by the cam for low speeds before the engine starts to run at the low speeds, resulting in poor drivability and emission control.

SUMMARY OF THE INVENTION

The primary object of the present invention is to eliminate the above-mentioned drawbacks. In order to achieve the object, according to the present invention, in an internal combustion engine having an oil pump with a relief valve which feeds lubricating oil to the engine by way of an oil delivery pipe and which feeds working oil to a hydraulic actuator for controlling valve timings of the engine by way of a branch pipe connected to the oil delivery pipe, there is provided an apparatus for controlling the feed of the oil discharged from the oil pump, which comprises a resistance valve unit in said oil delivery pipe downstream of the connection between the delivery pipe and the branch pipe, for allowing the lubricating oil to flow therethrough only when the delivery pressure of the discharged oil is above a predetermined value. The valve unit comprises a needle valve and a spring for forcing the needle valve into its closed position. The spring has an initial spring load which is smaller than that of the relief valve of the oil pump. Thus, sudden drops of the oil pressure immediately after actuation of the hydraulic cylinder cause the resistance valve unit to partly or completely close, depending upon the degree of drop, to decrease or cut off the feed of the lubricating oil passing through the resistance valve unit to the engine, thus resulting in priority feed of the working oil into the hydraulic cylinder.

Even when the reduced oil pressure is above the spring load of the resistance valve unit, the cross sectional area of the inlet port of the valve unit is decreased by an amount corresponding to the reduction in the oil pressure, decreasing the lubricating oil to be fed to the engine and increasing the working oil to be fed to the hydraulic cylinder.

BRIEF DESCRIPTION OF THE DRAWINGS

The invention will be now described in detail below with reference to the accompanying drawings, in which.

DETAILED DESCRIPTION OF THE INVENTION

Figure 1:
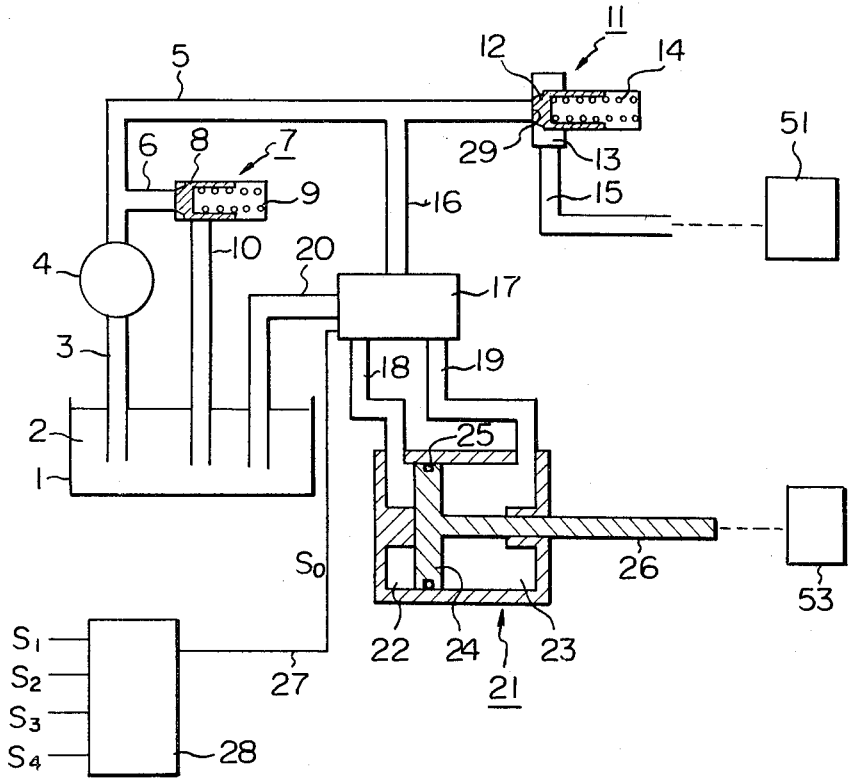
FIG. 1 is a partially sectioned schematic view of a control apparatus of the present invention.

In FIG. 1, an oil pan 1 is filled with an oil 2 for lubricating the engine 51. An oil pump 4 is driven by the engine 51, in accordance with the speed thereof, to deliver the oil 2 in the oil pan 1 into a delivery pipe 5. A relief valve unit 7 is provided in a branch pipe 6 which is connected to the delivery pipe 5. The relief valve unit 7 has a needle valve 8 which is biased by a spring 9. The spring 9 has an initial spring load sufficient to normally keep the oil pressure in the pipe 6 at about 5 to 6 kg/cm$^2$. The excess oil in the pipe 6 is returned to the oil pan 1 by means of a return pipe 10. Thus, the delivery pressure of the oil pump 4 is regulated substantially to a predetermined value.

A resistance valve unit (or check valve unit) 11 has a needle valve 12 which is biased by a spring 14 so that the needle valve 12 closes an inlet port 29 of the valve unit 11 which is connected to the delivery pipe 5. The pressure at which the needle valve 12 opens is smaller than that of the needle valve 8. The valve unit 11 has an annular groove 13 which surrounds the needle valve 12 and which is connected to a lubricating oil pipe 15. The pipe 15 is connected to the engine 51 to lubricate various sliding elements and/or bearing elements (not shown) of the engine, so that the oil discharged from the valve unit 11 is fed to the engine to lubricate the same.

A two-directional control valve unit 17 is connected to the delivery pipe 5 by means of a branch pipe 16. The valve unit 17 has a first working oil pipe 18, which is connected to a left chamber (first chamber) 22 of a double-acting hydraulic cylinder 21, a second working oil pipe 19, which is connected to a right chamber (second chamber) 23 of the cylinder 21, and a drain pipe 20, which is connected to the oil pan 1.

A central processing unit (CPU) 28 is electrically connected to the directional control valve unit 17 by means of a lead 27 and operates in response to signals representing parameters of the driving conditions of the engine, such as the speed ($S_1$), the temperature of the engine coolant ($S_2$), the engine load ($S_3$), and the temperature of the lubricating oil ($S_4$), to control the valve unit 17 so as to select a hydraulic connection between the pipes 16, 18, 19, and 20. Two patterns of combinations of such hydraulic connections can be selected in accordance with the engine driving conditions. In the first pattern (FIG. 1), the pipe 16 is connected to the pipe 19 and the pipe 18 is connected to the pipe 20. In the second pattern, the pipe 16 is connected to the pipe 18 and the pipe 19 is connected to the pipe 20.

The hydraulic cylinder 21 has a piston 24 which is slidably mounted in the cylinder in a fluid-tight fashion by means of a sealing element 25, such as an O-ring. The piston 24 has a piston rod 26 which is connected to a valve timing control means 53 to actuate the control means. That is, the hydraulic cylinder 21 is an actuator of the valve timing control means 53 for moving the means in axial directions of the cam shaft in order to selectively use the different cam profiles.

The resistance valve unit 11 is not limited to the illustrated angle type, but can be, for example, a conventional in-line type in which inlet and outlet ports of the valve are aligned in an axial line.

The apparatus according to the present invention, as described above, operates as follows.

The oil 2 in the oil pan 1 is raised by the oil pump 4, which is driven by the engine, in accordance with the engine speed and is discharged into the delivery pipe 5. When the oil pressure in the delivery pipe 6 is below the spring pressure, i.e., the initial spring load of the spring 9 in the relief valve unit 7, the needle valve 8 is closed, so that all of the discharged oil is fed to through the delivery pipe 5. On the contrary, when the oil pressure in the delivery pipe 6 is above the spring pressure of the spring 9, the needle valve 8 opens to establish a hydraulic connection between the delivery pipe 6 and the return pipe 10, so that a part of the oil discharged from the oil pump 4 flows through the relief valve unit 7 into the return pipe 10, thus preventing the oil pressure in the delivery pipe 5 from becoming higher than a predetermined value (usually 5 to 6 kg/cm$^2$).

The oil in the delivery pipe 5 tends to partly flow into the directional control valve 17 through the branch pipe 16. In the first position of the valve 17, the branch pipe 16 is connected to the second chamber 23 of the cylinder 21 by means of the second working oil pipe 19. When the pressure drives the piston 24 to its extreme left position, as shown in FIG. 1, no further oil can enter the second chamber 23. In this state, all of the subsequent oil in the delivery pipe 5 is fed to the resistance valve unit 11. Since the spring load of the spring 14 of the valve unit 11 is set to be smaller than that of the spring 9 of the valve unit 7, as mentioned before, the needle valve 12 opens against the spring 14, while compressing the spring 14, so that the annular groove 13 is hydraulically connected to the delivery pipe 5 by means of the inlet port 29. Therefore, the oil is fed to the engine by means of the lubricating oil pipe 15.

When a switching signal $S_0$ is fed from the CPU 28 to the two-directional control valve unit 17 by means of the lead 27, the valve unit 17 switches from the first position to the second position. The pipe 16 is thus connected to the pipe 18 and the pipe 19 is connected to the drain pipe 20, thereupon feeding part of the oil in the delivery pipe 5 into the first chamber 22 of the cylinder 21 and discharging the oil in the second chamber 23 of the cylinder 21 into the oil pan 1 by means of the drain pipe 20. As a result of the reduction in pressure of the oil in chamber 23, the piston 24 and the piston rod 26 move in the right-hand direction. This movement of the piston and the piston rod results in a transitional, large drop in the oil pressure in the delivery pipe 5. As soon as the oil pressure in the delivery pipe 5 becomes smaller than the spring load of the spring 14 of the valve unit 11, however, the valve unit 11 is closed, discontinuing the feed of the oil into the pipe 15, and, accordingly, allowing all of the discharged oil in the delivery pipe 5 to be fed to the first chamber 22 of the cylinder 21. This enables not only the rapid increase of the oil pressure in the delivery pipe 5, but also the increase of the speed of movement of the piston 24, which results in a shorter response time during which the valve timing control means 53 moves i.e., in a quick response of the displacement of the cam shaft or the rocker arm.

After the movement of the piston 24 is completed, the oil pressure in the delivery pipe 5 is again increased. The high oil pressure opens the valve unit 11 against the spring 14 and lubricating oil is again fed through the pipe 15 to the engine 51. When another switching signal $S_0$ is fed from the CPU 28 to the two-directional control valve unit, the valve unit 17 is switched back from the second position to the first position. The oil in the delivery pipe 5 is thus fed to the second chamber 23 of the cylinder 21, again resulting in a transitional drop in the oil pressure in the delivery pipe 5 closing completely or almost completely the valve unit 11. Accordingly, all or almost all of the oil is fed to the cylinder 21, ensuring, a quick return of the piston 24 to its left end position.

Figure 2:
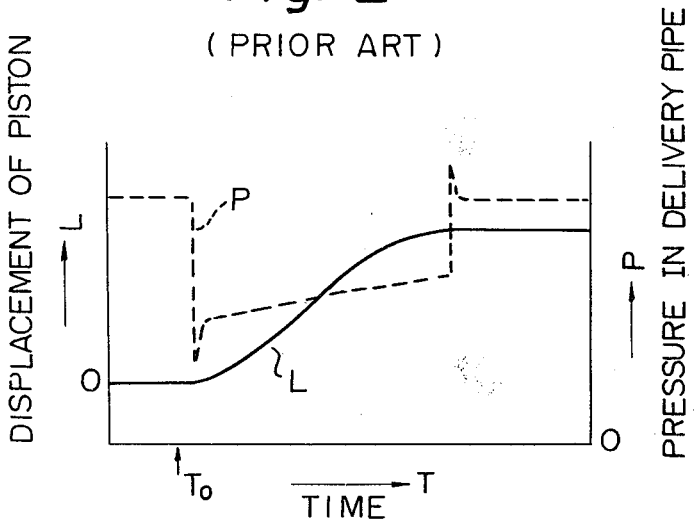
Fig. 2 (PRIOR ART)
FIGS. 2 and 3 are diagrams of characteristics of hydraulic cylinders showing relationships between the displacement of pistons of the hydraulic cylinders, the oil delivery pressure, and the time, according to prior art and according to the present invention, respectively.
Figure 3:
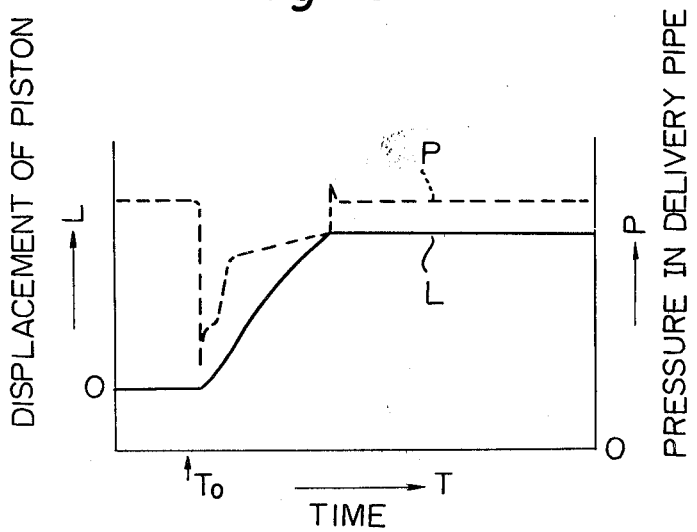

FIGS. 2 and 3 show relationships between the oil pressure P in the branch pipe 16 and the displacement L of the piston 24 for the case where no resistance valve unit 11 is provided (prior art) and for the case where a resistance valve unit 11 is provided (present invention), respectively. In FIGS. 2 and 3, the switching signal $S_0$ of the two-directional control valve unit 17 was given at time $T_0$ to switch the valve unit 17 from the first position to the second position, or vice versa. As can be seen from FIGS. 2 and 3, when a resistance valve unit 11 is provided (FIG. 3), the oil pressure P first undergoes a transitional, large drop then increases sharply immediately thereafter due to the closure of the valve unit 11. As a result, the speed of displacement of the piston 24 is higher than that in FIG. 2.

Figure 4:
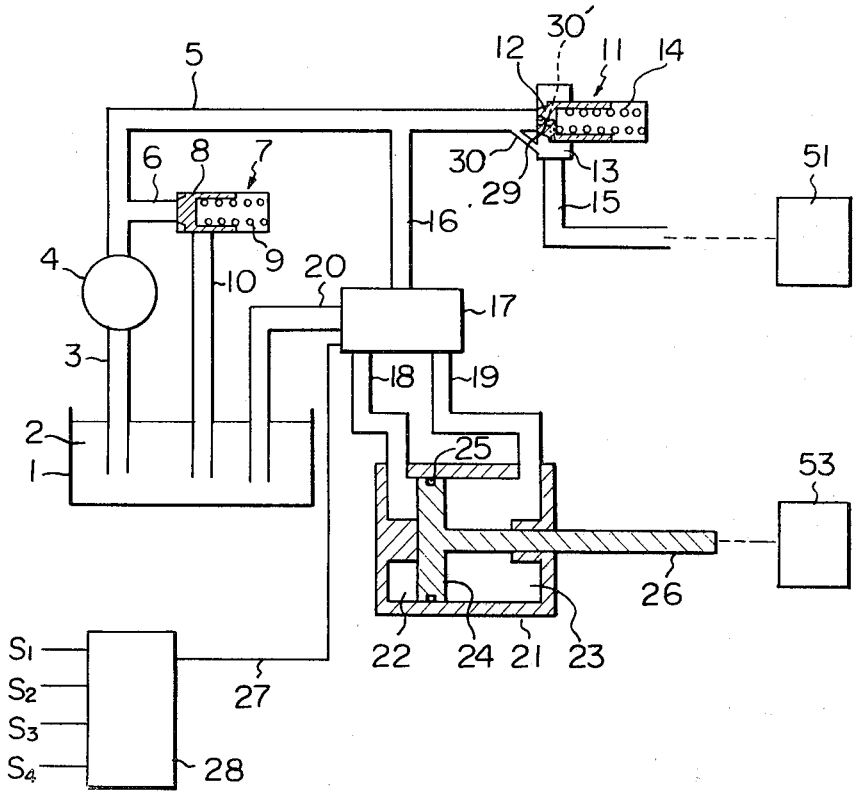
FIG. 4 is a view similar to FIG. 1, but showing another embodiment of the present invention.

FIG. 4 shows another embodiment of the invention. The only difference between FIGS. 1 and 4 is an additional passage 30, having a small diameter, which bypasses the resistance valve unit 11 and which extends between the delivery pipe 5 and the annular groove 13. The diameter of the bypass passage 30 must be considerably smaller than that of the delivery pipe 5.

The operation of the apparatus illustrated in FIG. 4 is essentially the same as that of the apparatus illustrated in FIG. 1. The difference is that when the engine speed is small, even when the oil pressure of the oil pump is not large enough to operate, i.e., open, the valve unit 11, the indispensable minimum amount of lubricating oil can be fed to the lubricating oil pipe 15 through the passage 30. Furthermore, also when the piston 24 comes to the extreme right end position and when the oil pressure in the delivery pipe 5 is decreased so that the resistance valve unit 11 is closed, the lubricating oil still continues to be fed to the pipe 15 by way of the bypass passage 30. It should be noted that since the diameter of the passage 30 is considerably small, the lubricating oil passing through the passage 30 when the valve unit 11 is closed has almost no effect on the oil pressure acting on the cylinder 21.

Alternatively, it is also possible to provide a bypass passage 30' in the needle valve 12, as shown by the broken line. The passage 30' extends through the needle valve 12 between the pipe 5 and the annular groove 13. The role of the passage 30' is identical to that of passage 30.

Figure 5:
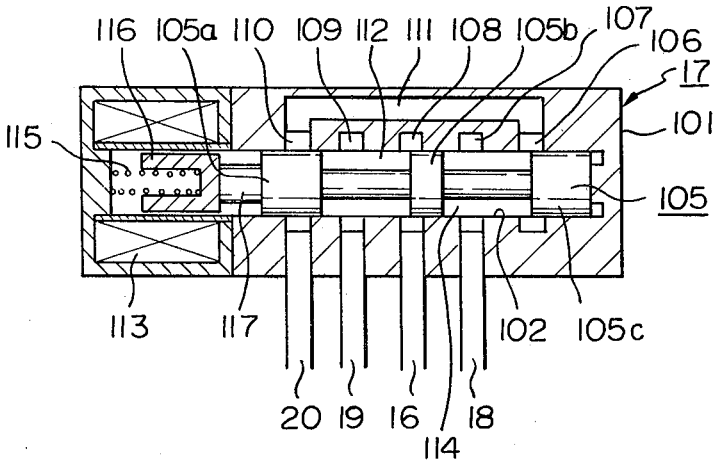
FIGS. 5 and 6 are longitudinal sectional views of an example of a directional control valve unit used in the present invention, shown in different valve positions.
Figure 6:
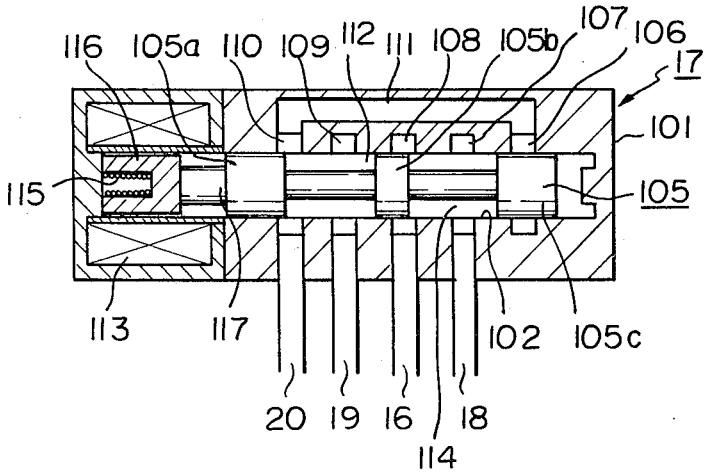

FIGS. 5 and 6 show an example of the directional control valve unit 17. A valve housing 101 has a hole 102 in which a spool valve 105 is slidably arranged in a liquid-tight fasion. The housing 101 has annular grooves 106, 107, 108, 109, and 110 which are selectively connected to each other by means of the spool valve 105. The groove 106 is continuously connected to the groove (fourth port) 110 by means of a connecting hole 111. The groove 110 is connected to the drain pipe 20 (FIGS. 1 and 4). The groove (first port) 107 is connected to the first chamber 22 (FIGS. 1 and 4) of the cylinder 21 by means of the first working oil pipe 18. The groove (second port) 108 is connected to the branch pipe 16 and, accordingly, to the delivery pipe 5 (FIGS. 1 and 4). The groove (third port) 109 is connected to the second chamber 23 of the cylinder 21 (FIGS. 1 and 4) by means of the second working oil pipe 19.

The spool valve 105 has a left end iron core 116 which is connected to the spool valve by means of a connecting rod 117. A magnetic coil 113 is provided around the iron core 116 to form an electromagnetic device. The spool valve 105 is biased in the right direction in FIG. 5 by means of the spring 115. WHen the electromagnetic device is ON, that is, when electric power is supplied to the coil 113, the iron core 116 is moved in the left direction against the spring 115, as shown in FIG. 6.

The spool valve 105 has two identical end portions **105*a* and 105*c* and an intermediate portion 105*b*. The end portion 105*a* and the intermediate portion 105*b* define a first annular space 112 in the hole 102, and the end portion 105*c* and the intermediate portion 105*b* define a second annular space 114 in the hole 102**.

When the spool valve 105 is in the first position illustrated in FIG. 5, the oil from the branch pipe 16 is fed to the second chamber 23 of the cylinder 21 by way of the annular groove 108, the annular space 112, the annular groove 109, and the second working oil pipe 19. On the other hand, the first working oil pipe 18 is connected to the drain pipe 20, by way of the annular groove 107, the annular space 114, the annular groove 106, the connecting hole 111, and the annular groove 110.

When electric power is supplied to the coil 113 in response to the switching signal $S_0$ of the CPU 28, the iron core and accordingly the spool valve 105 are moved in the left direction in FIG. 5 while compressing the spring 115, so that the spool valve 105 comes to its second position shown in FIG. 6. In this second position, the pipe 19, which is connected to the second chamber 23 of the cylinder 21, is connected to the drain pipe 20 by way of the annular groove 109, the annular space 112, and the annular groove 110. On the other hand, the pipe 18, which is connected to the first chamber 22 of the cylinder 21, is connected to the branch pipe 16 by way of the annular groove 107, the annular space 114, and the annular groove 108. In the second position of the spool valve 105, the piston 24 of the cylinder 21 is moved in the right direction in FIG. 1, as mentioned before.

As can be understood from the above description, according to the present invention, since a resistance valve unit which opens at an oil pressure smaller than the oil pressure at which the relief valve unit of the oil pump opens is provided in the delivery pipe connected to the oil pump for feeding lubricating oil to the engine and since the working oil of the hydraulic cylinder which actuates the valve timing control means is fed to the hydraulic cylinder from the delivery pipe between the oil pump and the resistance valve unit by way of the branch pipe, sudden drops of oil pressure during the operation of the hydraulic cylinder cause the resistance valve unit to largely or completely close, depending upon the degree of drop, to decrease or cut off the feed of the lubricating oil passing through the resistance valve unit to the engine, thus resulting in priority feed of the working oil into the hydraulic cylinder, rapidly increasing the reduced pressure of the working oil, and shortening the time it takes to displace the piston of the hydraulic cylinder.

Furthermore, the provision of a passage bypassing the resistance valve unit ensures that some lubricating oil is always fed to the engine no matter what the engine driving conditions.

We claim:

1. An apparatus for controlling the feed of oil discharged from an oil pump in an internal combustion engine having an oil pump with a relief valve which feeds lubricating oil to the engine by way of an oil delivery pipe and which feeds working oil to a hydraulic actuator for controlling valve timings of the engine by way of a branch pipe connected to the oil delivery pipe, comprising a valve means in said oil delivery pipe, which opens in accordance with the delivery pressure of the discharged oil to control the amount of the lubricating oil flowing therethrough, said branch pipe being connected to the oil delivery pipe between said oil pump and said valve means.

2. An apparatus according to claim 1, wherein said valve means comprises a needle valve which selectively closes the oil delivery pipe and spring means for forcing the needle valve into its closed position.

3. An apparatus according to claim 2, wherein said spring means has an initial spring load so that the valve means opens only when the delivery pressure of the oil is above a predetermined value which is smaller than the delivery pressure at which said relief valve opens.

4. An apparatus according to claim 3, further comprising passage means bypassing the valve means for allowing the lubricating oil to be fed to the engine even when the valve means is closed.

5. An apparatus according to claim 4, wherein said passage means comprises an oil passage having a diameter smaller than the diameter of the oil delivery passage.

6. An apparatus according to claim 5, wherein said oil passage is provided in said needle valve of the valve means.

7. An apparatus according to claim 5, wherein said oil passage bypasses the needle valve and extends between the upstream side and the downstream side of the needle valve.

8. Apparatus as in claim 1 including control valve means in said branch pipe operative in one instance to effectively block said branch pipe which turns off said actuator and rapidly causes said first mentioned valve means to open because of the resulting increased oil pressure then in said oil pipe, and operative in another instance to open said branch pipe to cause initial operation of said actuator resulting in a transitional relatively large drop in oil pressure in said oil pipe at said first valve means which closes for directing all the pumped oil via said branch pipe at increased pressure to said control valve means for quickening the operation of said actuator.

9. Apparatus as in claim 8 wherein said relief valve and first valve means open at different oil pressures, the latter being lower.

10. An apparatus for controlling the feed of the oil discharged from an oil pump in an internal combustion engine having an oil pump with a relief valve which feeds lubricating oil to the engine by way of an oil delivery pipe and which feeds working oil to a double-acting hydraulic cylinder with two working chambers for controlling valve timings of the engine by way of a branch pipe which is connected to the oil delivery pipe and which has therein a two-directional control valve having four ports, the first port being connected to the branch pipe, the second port to one of the two working chambers of said hydraulic cylinder, the third port to the other working chamber, and the fourth port to a drain, said two-directional control valve selectively occupying two positions, one of which makes hydraulic connection between the first and second ports and between the third and fourth ports, respectively, and the other of which establishes hydraulic connection between the first and third ports and between the second and fourth ports, respectively, wherein said apparatus comprises valve means in said oil delivery pipe for allowing the lubricating oil to flow therethrough when the delivery pressure of the discharged oil is above a predetermined valve, said branch pipe being connected to the oil delivery pipe between said oil pump and said valve means.

* * * * *